US007052331B2

(12) United States Patent
Maxwell et al.

(10) Patent No.: US 7,052,331 B2
(45) Date of Patent: May 30, 2006

(54) SYMMETRICALLY ADJUSTABLE CORROSION-RESISTANT BATTERY CABLE CONNECTOR

(76) Inventors: Scott D. Maxwell, 14269 145th Pl. SE., Renton, WA (US) 98059; Raymond Q. Draggie, P.O. Box 3378, Renton, WA (US) 98059; Marian Maxwell, 14269 145th Pl. SE., Renton, WA (US) 98059; Charles A. Lemaire, 13195 Flamingo Ct., Apple Valley, MN (US) 55124-7941

( * ) Notice: Subject to any disclaimer, the term of this patent is extended or adjusted under 35 U.S.C. 154(b) by 0 days.

(21) Appl. No.: 10/948,328

(22) Filed: Sep. 22, 2004

(65) Prior Publication Data

US 2005/0106952 A1 May 19, 2005

Related U.S. Application Data

(60) Provisional application No. 60/505,475, filed on Sep. 25, 2003.

(51) Int. Cl.
*H01R 4/42* (2006.01)

(52) U.S. Cl. ..... 439/758; 439/799; 439/764; 24/274 R; 24/279

(58) Field of Classification Search ..... 439/757, 439/758, 795, 799, 800, 764; 24/274 P, 24/274 R, 19, 20 LS, 279
See application file for complete search history.

(56) References Cited

U.S. PATENT DOCUMENTS

| | | | | |
|---|---|---|---|---|
| 2,525,447 | A * | 10/1950 | Clark | 439/799 |
| 3,678,449 | A | 7/1972 | Jones | |
| 3,699,494 | A * | 10/1972 | Thompson et al. | 439/100 |
| 3,769,665 | A | 11/1973 | McKown, Jr. | |
| 3,777,814 | A | 12/1973 | Gustavson et al. | |
| 3,887,895 | A * | 6/1975 | Pierzchala | 439/98 |
| 4,080,024 | A * | 3/1978 | Kroon | 439/98 |
| 4,664,469 | A * | 5/1987 | Sachs | 439/800 |
| 4,921,449 | A | 5/1990 | Fish | |
| 4,929,191 | A | 5/1990 | Dufresne | |
| 4,932,110 | A | 6/1990 | Tanaka | |
| 5,314,359 | A | 5/1994 | Probst | |
| 5,575,693 | A | 11/1996 | Dykas et al. | |
| 5,704,814 | A | 1/1998 | McCarthy | |
| 5,775,934 | A | 7/1998 | McCarthy | |
| 5,787,555 | A * | 8/1998 | Chen | 24/274 R |
| 5,809,619 | A * | 9/1998 | Schaub | 24/274 R |

(Continued)

FOREIGN PATENT DOCUMENTS

| | | |
|---|---|---|
| EP | 587882 B1 | 8/1995 |

(Continued)

*Primary Examiner*—Gary F. Paumen
(74) *Attorney, Agent, or Firm*—Charles A. Lemaire; Lemaire Patent Law Firm, P.L.L.C.

(57) ABSTRACT

An electromechanical connector for use between a power source such as a battery and a device requiring the power such as an automotive electrical system. In some embodiments, the connector includes a radius electrical contact constituting a primary electrical current path, and a band clamp with a slotted band constituting a secondary current path, and a worm drive adjustment assembly for symmetrically tighten the connector to the battery post. A kit is described having an electrical-contact conductor with a concave surface conforming to a battery post, and a band clamp to symmetrically compress the conductor against the post. Some embodiments provide a conductor that conforms to an outer portion of the post, and includes a band clamp mechanism with a band fixed at a non-moving end to the conductor, and at an opposite slotted end interfacing to a worm screw held against the conductor.

34 Claims, 7 Drawing Sheets

U.S. PATENT DOCUMENTS 5,839,924 A * 11/1998 Ritson ..... 439/757
5,886,611 A 3/1999 Schaller et al.
5,904,261 A 5/1999 Belinky et al.
6,004,163 A 12/1999 Behling et al.
6,018,137 A 1/2000 Reiff
6,074,243 A 6/2000 Edwards
6,123,567 A 9/2000 McCarthy
6,202,300 B1 * 3/2001 Yuzwalk ..... 29/863
6,232,577 B1 5/2001 Reiff
6,389,654 B1 5/2002 Tunno et al.
6,758,501 B1 7/2004 Amedure et al.
6,773,037 B1 * 8/2004 Spurgat ..... 285/23
6,860,527 B1 * 3/2005 Wagner et al. ..... 285/420

FOREIGN PATENT DOCUMENTS

EP 782775 B1 3/1996
EP 813269 B1 12/1997
EP 896388 B1 11/2003

* cited by examiner 300
700
301
71
302

737
301
320
99
700
71
710
739
90
320
321

99
400
401
70
Tilted Ducter Cylinder So hose Clamp Conforms to post taper
99
71
402

Shaped so hose clamp conforms
Tilted Cylinder
401
420
421
430

451
435
421
420

80
99
400
401
70
71
402
90
99

Cable attached To first half 2nd half movable
500

520
70
82
80
71
521
535
501

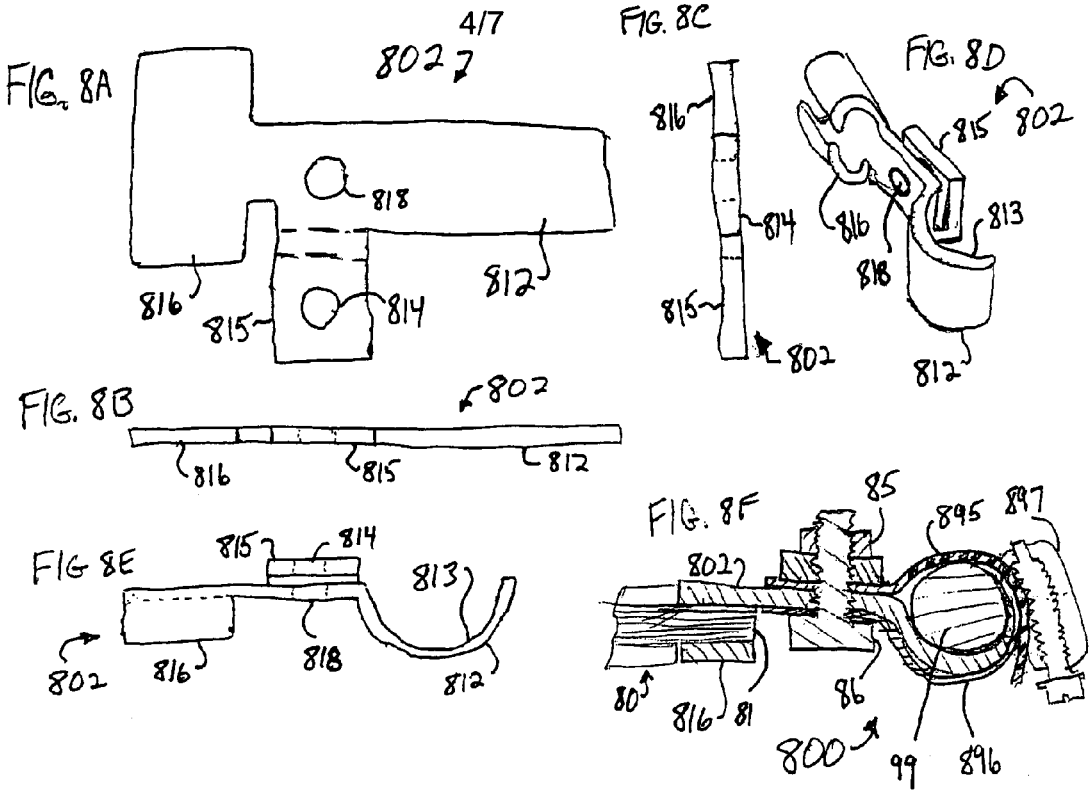
4/7
FIG. 8A
802
818
816
815
814
812
FIG. 8C
816
814
815
802
FIG. 8D
815
802
816
818
813
812
FIG. 8B
802
816
815
812
FIG 8E
815
814
813
802
816
818
812
FIG. 8F
85
895
897
802
80
816
81
86
800
99
896
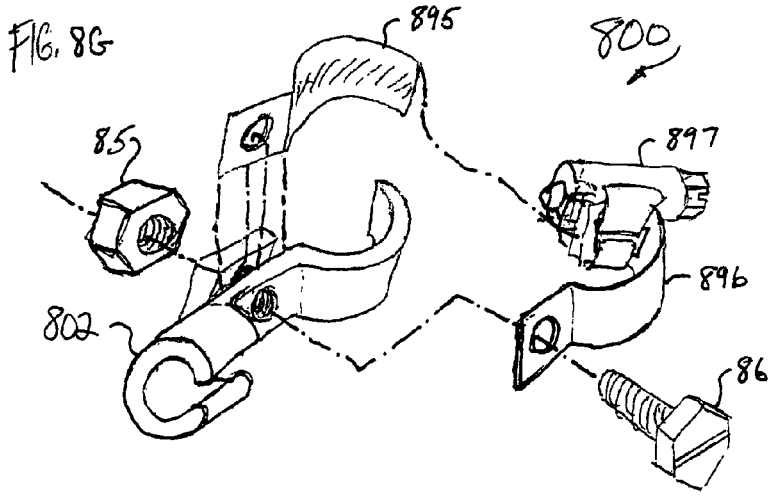
FIG. 8G
895
800
85
897
896
802
86

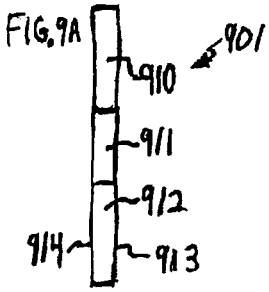
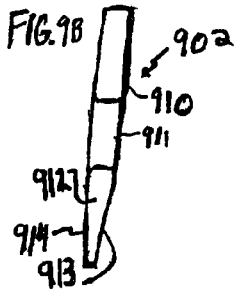
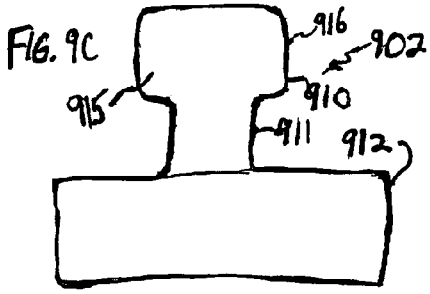
FIG. 9D
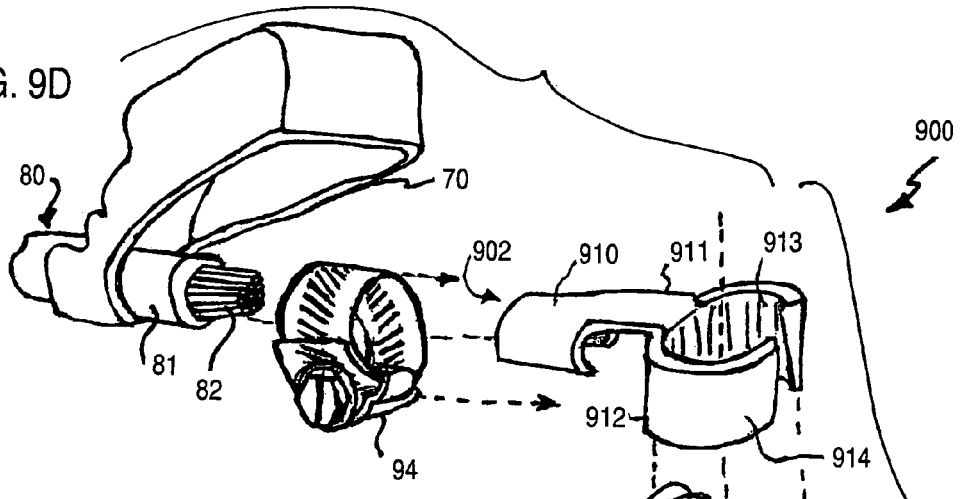
FIG. 9E
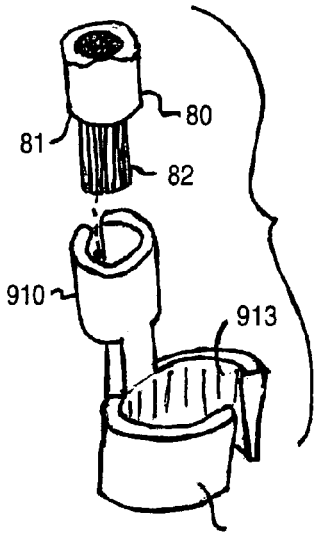

SYMMETRICALLY ADJUSTABLE CORROSION-RESISTANT BATTERY CABLE CONNECTOR

RELATED APPLICATION

This claims priority to U.S. Provisional Patent Application 60/505,475 with filing date Sep. 25, 2003, which is incorporated in its entirety by reference.

FIELD OF THE INVENTION

This invention relates generally to battery power systems and more specifically to symmetrically adjustable corrosion-resistant battery cable connectors and connection methods for automotive and marine battery power systems.

BACKGROUND OF THE INVENTION

Batteries typically are connected to their loads using a wire of suitable gauge terminated with a connector that is removably connectable to a battery terminal. Some conventional battery-post connectors provide a split-ring connector made of lead metal, having a tapered cylindrical primary opening, connected at a closed end to a cable wire, and having a steel nut-and-bolt fastener that passes through the open end and draws the two edges of the open end together when tightened, in order to provide a tight connection around the tapered cylindrical post of, for example, a lead-acid twelve-volt battery of a vehicle or watercraft.

Such battery-cable terminations historically have had problems with mechanical fit and deformation, material fatigue and breakage with use, and corrosion due to reactions with the battery electrolyte, road salt and fumes, and/or contact of dissimilar metals. Often, the nut and/or bolt will corrode, making removal and reattachment difficult. Even in cases where the bolt can be loosened, the C-shaped lead connector does not loosen by itself, but must be pried apart at its open end in order to remove it from a battery's post or to reinstall it. The loose fit of the cable-end connector on the post allows the interface between post and connector to oxidize, increasing resistance and making the battery difficult to charge and discharge properly. These problems result in either partial or complete failure of the terminal's primary function, which is to distribute adequate power to the battery-powered systems and loads.

Although there have been improvements made to help reduce the above problems by various means in the industry, the problems mentioned above still exist. Therefore, there still exists a need to make further improvements, especially in applications which are deemed critical as with military vehicles and civilian rescue vehicles.

SUMMARY OF THE INVENTION

The present invention addresses the aforementioned problem areas including mechanical fit, material fatigue and corrosive behavior. It also provides features to the connector that make it easier for the user to install, remove, and/or replace in the field.

The present connector provides symmetrical clamping to the battery-terminal post, ensuring good electrical contact. The configuration and the materials used in construction of the connector of the present invention reduce the tendency for it to fail as compared to other battery-terminal connectors. The tendency for corrosion to take place is reduced by the materials used and by limiting chemical seepage routes with the connector's symmetrically tight contact. The present design includes the added benefit of extreme ease of installation and removal with any one of several different tools. In some embodiments, the present invention uses materials that are less toxic and less harmful to the environment, as compared to conventional lead-based connectors.

In some embodiments, a replaceable conventional band clamp is used to surround the connector and the battery post of the lead-acid battery to which it is connected. In some embodiments, the band, the screw holder, and the screw that tightens the clamp are made of stainless steel, while the connector includes tin-coated copper for improved conductivity. In other embodiments, the conductor includes lead-brass alloy, lead-copper alloy, or a beryllium alloy, and optionally includes a radius contact plated with tin, silver, or brass.

As used herein, "band" and "strap" mean the same thing: a strong, relatively thin, strip of metal or other suitable material. In some embodiments, such a band is made of stainless steel and typically has a plurality of crosswise or diagonal slots that interface with a worm-drive screw's threads.

BRIEF DESCRIPTION OF THE DRAWINGS

The present invention is described in detail below with reference to the following drawings.

FIG. 8A is a plan view, before folding, of a stamped-metal radius conductor 802.

FIG. 8B is an end view, before folding, of a stamped-metal radius conductor 802.

FIG. 8C is a side view, before folding, of a stamped-metal radius conductor 802.

FIG. 8D is a perspective view, after folding, of a stamped-metal radius conductor 802.

FIG. 8E is a top view, after folding, of a stamped-metal radius conductor 802.

FIG. 8F is a top cut-away view of a battery connector 800.

FIG. 8G is a perspective exploded view of a battery connector 800.

FIG. 9A is a side view, before folding, of a stamped-metal radius conductor 901.

FIG. 9B is a side view, before folding, of a stamped-metal radius conductor 902.

FIG. 9C is a plan view, before folding, of a stamped-metal radius conductor 902.

FIG. 9D is a perspective exploded view of a replaceable-clamp battery connector 900.

FIG. 9E is a perspective exploded view of a replaceable-clamp battery connector 904.

DETAILED DESCRIPTION OF THE INVENTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Figure 1A:
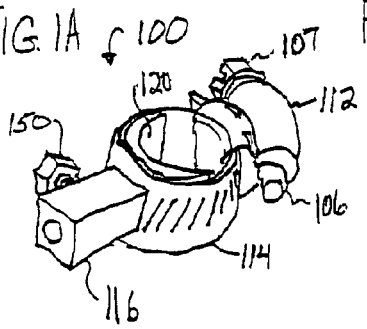
FIG. 1A is a perspective view that illustrates connector assembly 100 of some embodiments, including a worm drive adjustment assembly 112, a slotted adjustment strap 114, and a radius electrical contact 116.

FIG. 1A is a perspective view that illustrates connector assembly 100 of some embodiments, including a worm drive adjustment assembly 112, a slotted adjustment strap 114, and a radius electrical contact 116. Connector assembly 100 illustrates an exemplary battery-cable connector that makes significant improvements to battery power distribution systems in historically problematic areas. The assembly 100 includes a worm-drive adjustment assembly 112 that is mechanically coupled to a slotted adjustment strap 114. As slotted adjustment strap 114 is tightened, its circumference is reduced and it compresses around a battery's electrical power post 99 (see FIG. 9D) and a radius electrical contact 120, which provides a primary electrical current carrying site as well as an attachment site 116 for the battery cable's electrical conductor wires.

One important feature of assembly 100 is its ability to conform to the round battery post. In some embodiments, the opening at the center of this connector assembly 100 is substantially round and cylindrical (or, in some embodiments, a tapered cylindrical shape, such as a conical section). As the worm drive screw 104 (see FIG. 1E and FIG. 1F) is rotated, the diameter of the connector is either expanded or contracted maintaining a substantially round opening. The slotted adjustment strap 114 (see FIG. 1D) has an opening 117 for post 127 of electrical contact 116 to fit through, and is symmetrically expanded or contracted so as to equally distribute the stress of this action across its entirety. This prevents premature material fatigue experienced by some other connectors. In addition, since the shape of the opening can be substantially circular, for battery electrical power posts that are circular, mechanical fit or interfacing is optimized. Further, since a portion of the circumference of the battery post has only the band clamp, this portion can more easily conform to a post that happen not to be cylindrical (for example, if the post has been damaged).

Another important feature of assembly 100 is its ability to release from the battery post when the screw is loosened without having to pry apart the ends of the electrical conductor 116. Some conventional battery-cable connectors are made from lead which is deformed in the process of attachment. This makes reattachment difficult, and the lead can be an environmental hazard. Some other connectors are assembled into a split-ring arrangement which places high stress 180 degrees from the split when detached. With both of these arrangements, future good fit is not guaranteed as deformation is likely to have taken place. With the connector 100, deformation is small or does not occur with detachment and reattachment, so good fit is ensured.

To maintain good electrical contact, good fit is very important, since electrical conductance is defined by the resistance of the electrical contact area. Since mechanical fit is ensured by the subject connector 100, electrical contact is improved.

In addition to mechanical fit, the condition of the interfacing materials influence the electrical resistance of those materials. The subject connector 100 is designed to have a primary and secondary conduction path to ensure conduction. The inner radius 121 of electrical contact 116 is the primary conduction path, and is in direct electrical contact with the battery post. In some embodiments, the material to be used for its construction is tin-coated copper. In other embodiments, brass plated copper, silver plated lead-copper alloy, silver plated copper, silver plated lead-brass alloy, or silver plated beryllium are used. The copper is used to be galvanically compatible with copper wire cables. The battery-contact surface is coated with and/or alloyed with tin so as to be galvanically compatible with a typical lead battery post. These materials reduce the tendency for corrosion to take place due to metal dissimilarity. In some embodiments, the primary contact is a highly electrically conductive material that is galvanically compatible with the battery terminal material and corrosion resistant, and the lug is a highly electrically conductive material that is galvanically compatible with the conductive cable and corrosion resistant.

At end 127 opposite the battery terminal contact surface 121, the electrical contact 116 is adapted for connection to a wire cable for power distribution such as a solder-in socket, a set screw, a crimp connection, etc.

A secondary conduction path is provided by the slotted adjustment strap 114. In some embodiments, strap 114 is in contact with the battery terminal over a large surface area. In some embodiments, this strap is made of a material that includes stainless steel. The stainless steel material, though initially having a higher resistivity than the radius electrical contact 116 material, will remain substantially uncorroded, and if the primary path is compromised, will provide a secondary conduction path. Extra assurance of a conduction path is especially important for certain battery-power installations that service human survival issues (i.e., military and emergency vehicles).

Since a tight mechanical fit is ensured, there is less tendency for foreign material to seep into the interfacing surfaces of the connector and the battery terminal. This is another element that ensures good electrical contact and conduction.

The present invention describes connectors that are inexpensive to build and easy to use, and have advantages over other conventional connectors. Embodiments if the invention such as shown in FIGS. 1A–1G and FIGS. 8A–8G have been tested in the vehicle of one of the inventors and been found to function better than other connectors he had encountered in the following ways:

It is extremely easy to install and remove using several different varieties of tools;

It conforms to the battery post better than the other connectors, at least in part because the slots in the clamp allow for some amount of a tapered clamping, so that even if the walls of the conductor (e.g., surfaces 120 and 121 if conductor 116 of FIG. 1G, or surfaces 912 and 193 of FIG. 9D) are parallel to one another, the surrounding band clamp (112 and 114 of FIG. 1A, or 95 of FIG. 9D) can tighten to a tapered-cylindrical shape, in some embodiments.

It does not deform like lead connectors and is symmetrically adjustable, which others are not.

The clamp strap distributes the strain around in a hoop, so stress is not concentrated in one location like it is with other non-symmetrically adjusting connectors, and it will not break as soon as they ultimately do.

The copper contact is tin coated which keeps the contact from corroding and tin is close to lead on the galvanometric scale so electrolysis does not appreciably occur.

The stainless clamp provides a secondary electrical current path, which by his own experience in test, stays substantially corrosion-free, so reliability is much improved compared to other connectors. (After a year of test the connector showed "no" visible evidence of corrosion, electrolysis, discoloration due to heat, etc.

It also is environmentally friendly, whereas the popular lead connector is environmentally hazardous (e.g., the popular battery-terminal-cleaning wire brushes, when used to clean the inner surfaces of conventional lead-based connectors, scrape off and drop tiny particles of lead, lead oxides, and other lead corrosion, which end up falling to the floor or a garage or to the ground, where they may be injested by a child or pet, or contaminate the soil).

Due to these advantages, the "mean time between failure" should be much greater than other connectors and qualify connectors of the invention for service in adverse and critical situations (e.g., military, marine, aircraft, rescue vehicles, etc.).

Figure 1B:
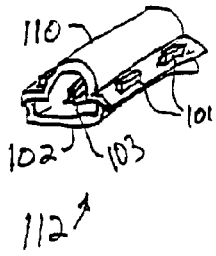
FIG. 1B is a perspective view that provides detail of the worm drive adjustment assembly 112, illustrating the worm drive screw housing 110, and the adjustment strap guide 102.

FIG. 1B is a perspective view of adjustment housing 112, showing detail of one embodiment of the worm-drive-screw housing 110 and the adjustment-band guide 102. These parts hold the worm-drive screw 104 and the slotted-adjustment band 114 in mechanical communication and alignment. As discussed earlier, the rotation of the worm-drive screw 104 expands or contracts the diameter of the connector opening. This arrangement provides a connector that is much more easily attachable and detachable as compared to conventional connectors. To further enhance its ease of use, some embodiments of worm-drive screw 104, as shown in FIG. 1E, provide a slot for use with a conventional slotted screw driver, a cross slot for use with a conventional Philips-type screw driver and a hexagonal head for use with conventional hexagonal box end and sockets, open end and/or adjustable wrenches. This ease of use will be important in the field where choice of tools is restricted.

FIG. 1B is a perspective view that provides detail of the worm-drive adjustment assembly 112, illustrating the worm drive screw housing 110, and the adjustment strap guide 102. In some embodiments, strap guide 102 provides one or more tabs 103 that attach to band 114 through opening 113. One or more other tabs 101 fasten strap guide 102 to housing 110.

Figure 1C:
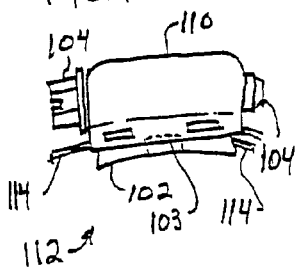
FIG. 1C is a side view illustrating worm-drive screw 104 mounted within assembly 112.

FIG. 1C is a side view illustrating worm-drive screw 104 mounted within assembly 112. Housing 110 has ends that secure to grooves in screw 104 and hold it in place while allowing it to rotate about its longitudinal axis.

Figure 1D:
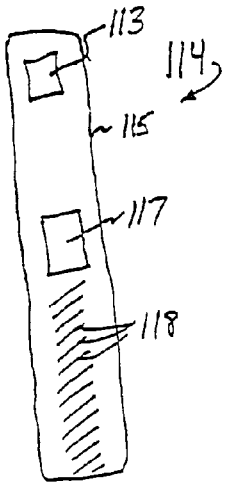
FIG. 1D is a plan view that illustrates the slotted adjustment strap 114.
Figure 1E:
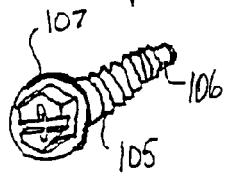
FIG. 1E is a perspective view of worm-drive screw 104.

FIG. 1D is a plan view that illustrates the slotted adjustment strap or band 114. In some embodiments, band 114 includes a thin stainless-steel strap 115 having a plurality of slots or embossed grooves 118 that interface to the threads of screw 104 to tighten or loosen the clamp, a hole 117 through which post 116 is inserted, and a hole 113 through which tabs 103 of strap guide 102 are bent to fixedly attach the band guide 102 to the band 114.

FIG. 1E is a perspective view of worm-drive screw 104. In some embodiments, head 107 is made to allow driving from any one of a plurality of different tools; e.g., by providing a hex outside head, and inner grooves for both flat and Philip's head screwdrivers, in order to allow more flexibility in tool selection in field repairs.

Figure 1F:
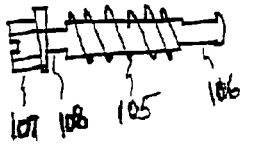
FIG. 1F is a side view of worm-drive screw 104.

FIG. 1F is a side view of worm-drive screw 104, showing hex head 107, head groove 108 that rides in a slot in one end of housing 110, and tip groove 106 that rides in a slot in the opposite end of housing 110. Threads 105 interface to slots 118 in strap 114.

Figure 1G:
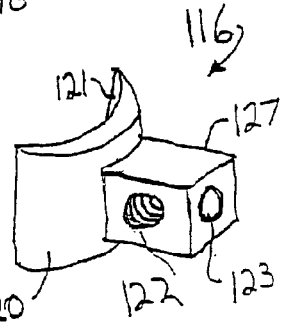
FIG. 1G is a perspective view of radius electrical contact 116.

FIG. 1G is a perspective view of radius electrical contact 116. Electrical contact 116 includes an inner radius surface 121 that has a concave cylindrical or tapered cylindrical shape to match the shape of post 99 to which it contacts, and a convex cylindrical shape to conform to the shape of the tightened band 114 while minimizing stresses that can occur if a non-cylindrical shape is used. Post 127 has a shape suitable to fit through hole 117, while leaving a substantial width of band on either side for band strength. In some embodiments, a rectangular cross section is used, having a hole 123 into which the wire-conductor end 82 (see FIG. 2A) of the battery cable 80 is inserted, and a threaded hole 122 into which a bolt 150 can be inserted to clamp against the wire-conductor end 82. In other embodiments, other wire connection means are used, such as, for example, welding, soldering and/or crimping.

Figure 2A:
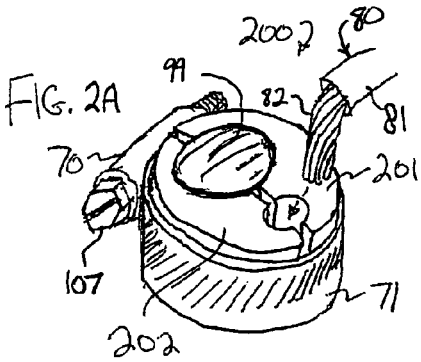
FIG. 2A is a perspective view of a connector assembly 200 of some embodiments of the invention.

FIG. 2A is a perspective view of a connector assembly 200 of some embodiments of the invention. In some embodiments, connector assembly 200 uses a conventional prior-art worm-drive band clamp 70 having a strap 71 that surrounds two complementary conductors 201 and 202. In other embodiments, any other suitable types of band clamps (which are well known) can be substituted for worm-drive band clamp 70.

Figure 2B:
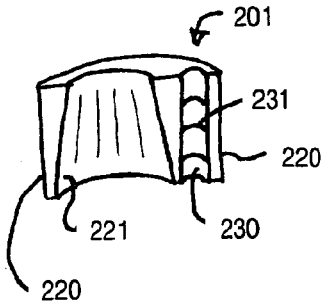
FIG. 2B is a perspective view of electrical contact 201 of connector assembly 200.

FIG. 2B is a perspective view of electrical conductor or contact 201 of connector assembly 200. In some embodiments, conductor 201 includes a cylindrical or tapered cylindrical groove 221 that conforms to and tightens against a section of battery post 99, and a cylindrical or tapered cylindrical groove 230 that conforms to and tightens against a section of wire conductor end 82. In some embodiments, grove 230 includes one or more projecting ridges that help prevent wire end 82 from being pulled out, and enhance the conductivity of the connection. Band clamp 70 tightens conductor 201 towards conductor 202, tightening against both battery post 99 in groove 221, and against wire end 82 in groove 230. In some embodiments, the outer surface 220 of conductors 201 and 202 are formed such that when installed on a post 99 and wire end 82, the outer circumference forms a cylindrical shape to minimize stress on band clamp 70 and even out the forces applied.

Figure 7A:
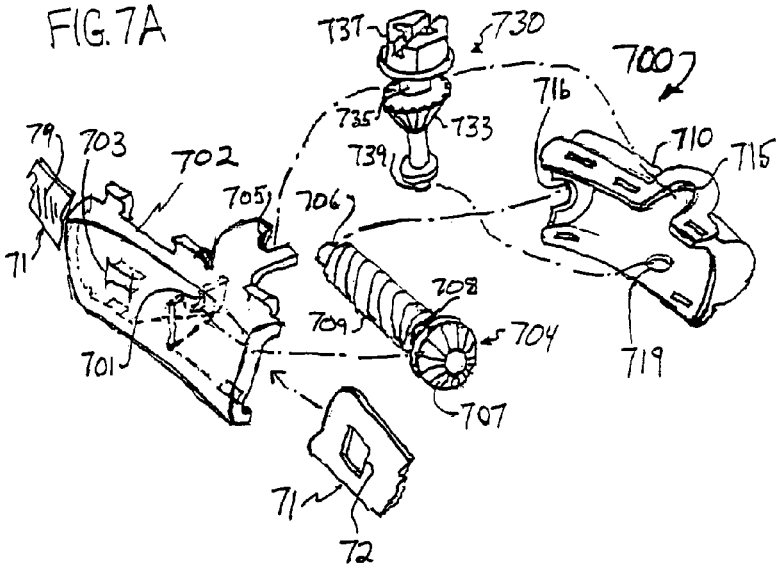
FIG. 7A is a perspective exploded view of top-driven clamp 700 that allows actuating beveled-gear worm-drive screw 704 with vertically oriented beveled-gear head 730.
Figure 3A:
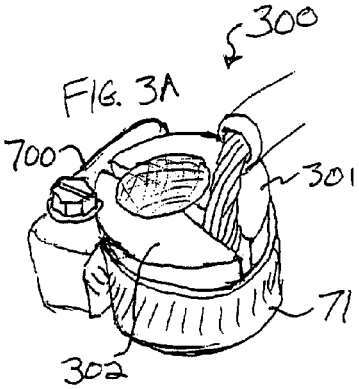
FIG. 3A is a perspective view of a connector assembly 300 of some embodiments of the invention.

FIG. 3A is a perspective view of a connector assembly 300 of some embodiments of the invention. Connector assembly 300 is similar to connector assembly 200 of FIG. 2A, however conductors 301 and 302 do not have a groove (such as 230) for wire end 82, but instead present substantially flat surfaces between which the wire end 82 is clamped. In some embodiments, a top-drive band clamp 700, such as described in FIG. 7A is used, allowing tightening and loosening from the top using a vertically-oriented screwdriver or other tool. This is particularly useful to enhance safety where geometric considerations preclude safe use of metal tightening tools (which can short electrical current to surrounding metal structures in a car) to a horizontal head 107 such as shown in FIG. 2A.

Figure 3B:
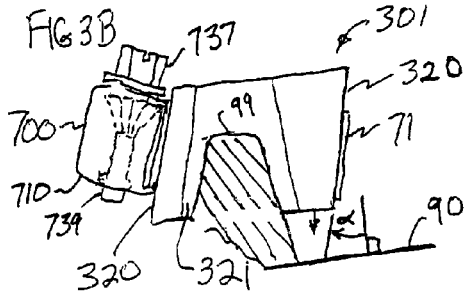
FIG. 3B is a perspective view of electrical contact 301 of connector assembly 300.

FIG. 3B is a perspective view of electrical contact 301 of connector assembly 300, according to some embodiments of the invention. Note that in some embodiments, the outer surface 320 is a cylindrical shape, but not oriented around a vertical axis. Rather, the cylinder of the outer surface is tilted at an angle alpha, to provide a more convenient angle to the drive head 737 of clamp 700, and to provide more clearance between the bottom end 739 of the worm screw and the top surface of the battery 90. In some embodiments, inner battery-post groove 321 is cylindrical, while in other embodiments, groove 321 is a tapered cylinder to conform to the shape of battery post 99. Because of the tilt of cylindrical surface 320, the right-most lower edge of band 71 is closer to the top surface of battery 90 than is its left-most lower edge. Since the right-most upper edge is also lower, this allows the wire 80 to exit towards the left just above the upper edge of band 71.

Figure 4A:
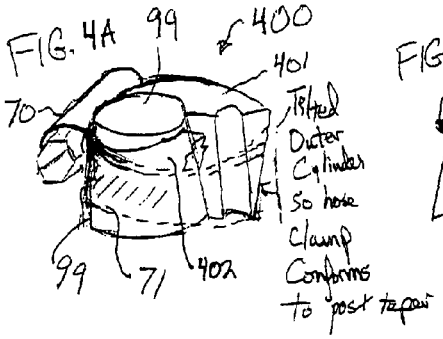
FIG. 4A is a partially-cut-away perspective view of a connector assembly 400 of some embodiments of the invention.

FIG. 4A is a partially-cut-away perspective view of a connector assembly 400 of some embodiments of the invention. In some embodiments, a conventional horizontal-screw worm-drive band clamp 70 is used. In other embodiments, a top-drive band clamp 700, such as described in FIG. 7A is used, allowing tightening and loosening from the top using a vertically-oriented screwdriver or other tool. Connector assembly 400 is similar to connector assembly 300 in having a tilted-cylinder outer surface on conductors 401 and 402, however the left edge of this outer cylinder 420 is shifted (or "shaved") to the right, and thus intersects the inner groove 421 leaving a much smaller portion of surface 421 to contact battery post 99. This exposes a portion of post 99 to make direct contact to band clamp 70, and provide an alternate current path through band 71 and other portions of clamp 70.

Figure 4C:
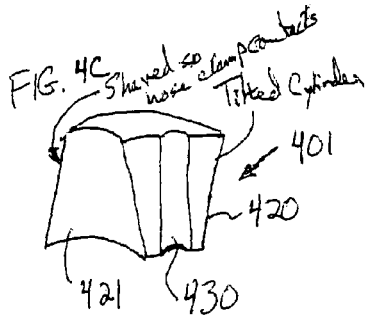
FIG. 4C is a perspective view of electrical contact 401 of connector assembly 400.
Figure 4D:
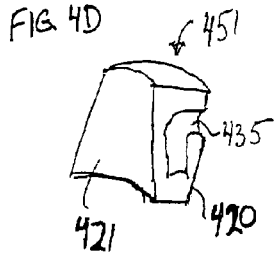
FIG. 4D is a perspective view of electrical contact 451 that can be substituted in connector assembly 400.
Figure 4B:
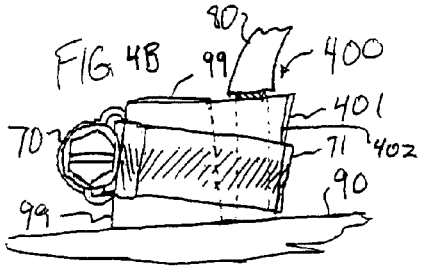
FIG. 4B is a partially-cut-away side view of a connector assembly 400 of some embodiments of the invention.

FIG. 4B is a side view of a connector assembly 400 of some embodiments of the invention. Connector assembly 400 includes a conventional band clamp 70 surrounding conductors 401 and 402 that press against post 99 of battery 90, and against the conductors of wire 80.

FIG. 4C is a perspective view of electrical contact 401 of connector assembly 400. Inner post groove 421 is made to only partially surround its half of post 99, and intersects with cylinder surface 420 at a line that allows clamp 70 to contact post 99 as well. Groove 430 is provided to clamp against wire 80.

FIG. 4D is a perspective view of electrical contact/conductor 451 that can be substituted in connector assembly 400. Conductor 451 provides a bent grove 435 that allows the sideways exit of wire 80 and provides enhanced holding of the wire which is also bent when inserted. Otherwise, conductor 451 is identical to conductor 401 and can be substituted into the connector assemblies of FIG. 2A, 3A, or 4A.

Figure 5:
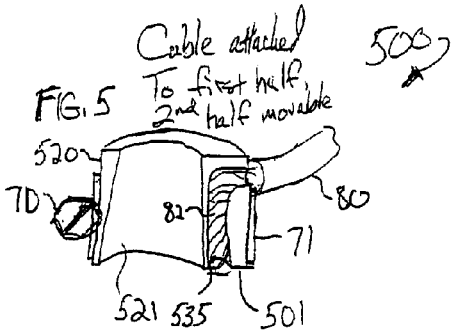
FIG. 5 is a perspective view of electrical contact 501 that can be substituted in connector assembly 200 of FIG. 2A.

FIG. 5 is a perspective view of electrical contact/conductor 501 that can be substituted in connector assemblies of FIG. 2A, 3A, or 4A, according to some embodiments of the invention. Conductor 501 is similar to conductor 201, except that it includes a bent groove to which wire 80 is permanently affixed (e.g., by welding or soldering).

Figure 6A:
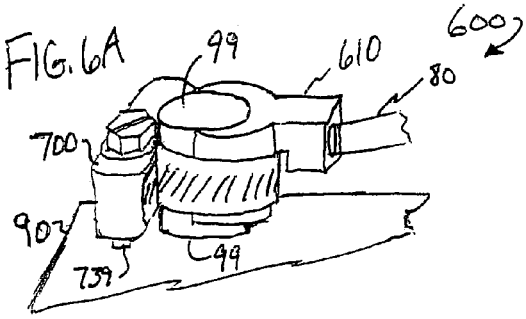
FIG. 6A is a perspective view of a connector assembly 600 of some embodiments of the invention.

FIG. 6A is a perspective view of a connector assembly 600 of some embodiments of the invention. Connector assembly 600 includes a top-drive band clamp 700 (or a conventional band clamp 70 can be substituted) surrounding a single-piece conductor 610. Unlike conductor 116 of FIG. 1A, conductor 610 does not need a hole in band clamp 700, but provides a wire connection that passes above band clamp 700.

Figure 6F:
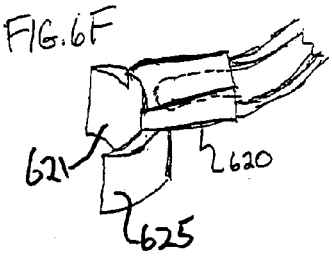
FIG. 6F is a perspective view of electrical contact 620 that can be substituted in connector assembly 600.
Figure 6B:
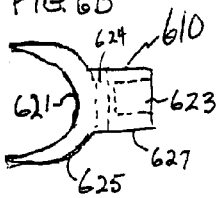
FIG. 6B is a top view of electrical contact 610 of connector assembly 600.

FIG. 6B is a top view of electrical contact/conductor 610 of connector assembly 600. In some embodiments, conductor 610 includes an inner surface 621 that conforms to a battery post 99, an outer cylindrical surface 625 that band clamp 700 tightens against, a groove 624 to allow band clamp 700 to ride higher on the battery post, giving more clearance at the bottom for screw end 739, and a hole 623 in side post 627 for the cable wire end 82.

Figure 6C:
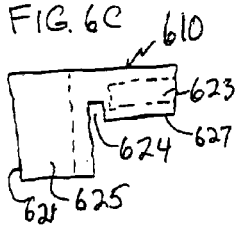
FIG. 6C is a side view of electrical contact 610 of connector assembly 600.

FIG. 6C is a side view of electrical contact/conductor 610 of connector assembly 600. The features are described above.

Figure 6D:
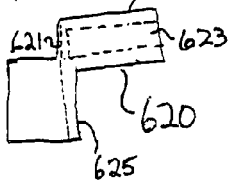
FIG. 6D is a side view of electrical contact 620 that can be substituted in connector assembly 600.

FIG. 6D is a side view of electrical contact/conductor 620 that can be substituted in connector assembly 600. Conductor 620 eliminates the groove 624 of conductor 610, but has post 627 higher relative to the top of the battery post 99.

Figure 6E:
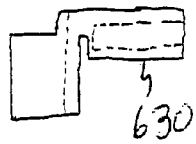
FIG. 6E is a side view of electrical contact 630 that can be substituted in connector assembly 600.

FIG. 6E is a side view of electrical contact/conductor 630 that can be substituted in connector assembly 600. Conductor 630 is a combination of conductor 620 and conductor 610.

FIG. 6F is a perspective view of electrical contact/conductor 620 of FIG. 6D that can be substituted in connector assembly 600.

FIG. 7A is a perspective exploded view of top-driven clamp 700 that allows actuating beveled-gear worm-drive screw 704 with vertically oriented beveled-gear head 730, according to some embodiments of the invention. Top-driven clamp 700 has a tightening mechanism having a vertical head (at right angles to the plane of the band clamp 114) for connector adjustment. In the event that there is physical interference so that adjustment from the side of the connector is difficult, this embodiment allows the user to adjust the connector from above. A beveled-gear head 730 is employed in the vertical position, in mating contact with the worm drive screw 704 which now has a gear head 707.

In some embodiments, strap guide 702 permanently holds a conventional slotted band 71 by inserting tabs 703 into hole 72. Groove 701 mates with groove 708 of screw 704 allowing the screw to rotate, while groove 705 mates with groove 735 of beveled-gear head 730 allowing the beveled-gear head 730 to rotate. The opposite end groove 706 of screw 704 is held and rides in groove 716 of housing 710, while the opposite end groove 739 of beveled-gear head 730 fits in hole 719 of housing 710. The slotted end of band 71 is urged against screw 704, such that the slots 79 of the band interface to the threads 709 of the screw. The tabs of strap guide 701 are attached through corresponding slots in housing 710 to assemble the clamp 700.

Figure 7B:
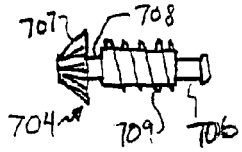
FIG. 7B is a side view of beveled-gear worm-drive screw 704.

FIG. 7B is a side view of beveled-gear worm-drive screw 704, used in some embodiments. Screw 704 includes a bevel gear 707 that meshes with gear 733 of the head 730. Grooves 708 and 706 provide sleeve-bearing surfaces that rotate within groove 716 of housing 710 and groove 701 of strap guide 702.

Figure 7C:
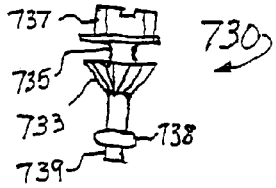
FIG. 7C is a side view of vertical beveled-gear head 730.

FIG. 7C is a side view of vertical beveled-gear head 730. Beveled-gear head 730 includes a bevel gear 733 that meshes with gear 707 of screw 704. Grooves 735 and 739 provide sleeve-bearing surfaces that rotate within groove 715 of housing 710 and groove 705 of strap guide 702, and hole 719 of housing 710. Collar 738 holds the beveled-gear head 730 on top of hole 719. In some embodiments, a multi-tool capable hex head 737 is provided.

FIG. 8A is a plan view, before folding, of a stamped-metal radius conductor 802. Conductor 802 includes ears 816 for bending into a cylindrical opening for wire end 82, tab 815 for folding into a U-shape to align hole 814 to hole 818 and surround an end of slotted strap 895. A strap end 812 is bent to a semi-cylindrical shape such that an inner surface 813 conforms to and outer surface of the battery post 99. In some embodiments, conductor 802 is made of a metal, e.g., primarily or substantially totally copper. In some embodiments, at least inner surface 813 is coated or alloyed with tin. FIG. 8B is an end view, before folding, of stamped-metal radius conductor 802. FIG. 8C is a side view, before folding, of stamped-metal radius conductor 802. FIG. 8D is a perspective view, after folding, of stamped-metal radius conductor 802. FIG. 8E is a top view, after folding, of a stamped-metal radius conductor 802.

FIG. 8F is a top cut-away view of a battery connector 800, according to some embodiments of the invention, which utilizes conductor 802. In some embodiments, connector 800 uses a worm-drive screw assembly 897 similar to that of top-drive band clamp 700 or of a conventional band clamp 70, however the band or strap is split into two parts: strap 896 that is permanently attached to worm-drive screw assembly 897 and is held by bolt 86, and slotted strap 895 that interfaces with the worm screw of worm-drive screw assembly 897, and is held at its other end in the U-slot of conductor 802 by bolt 86 as attached to nut 85. FIG. 8G is a perspective exploded view of a battery connector 800.

FIG. 9A is a side view, before folding, of a stamped-metal radius conductor 901. When bent and folded, ears 916 and 915 of end 910 form a cylinder to hold wire end 82, ears 912 form a cylinder having an inner surface 913 to hold battery post 99 and an outer surface 914 around which a band clamp 70 or 700 is placed, and neck 911 that can be left in a vertical orientation as shown in FIG. 9E, or folded over as shown in FIG. 9D.

FIG. 9B is a side view, before folding, of a stamped-metal radius conductor 902 (that can be substituted in some embodiments, for conductor 901) that includes a beveled surface 913, which, when bent to form a tapered cylindrical shape to conform to the battery post 99, allows the outer surface 914 to conform to a cylindrical shape against which a band clamp is applied.

FIG. 9C is a plan view, before folding, of a stamped-metal radius conductor 902. This plan view would also be applicable to conductor 901. Ears 915 and 916 of cable connection end 910 are bet to form a cylindrical opening (see FIG. 9D).

FIG. 9D is a perspective exploded view of a replaceable-clamp battery connector 900, according to some embodiments of the invention. In some embodiments, connector 900 is provided to the user as a kit of parts including some or all of those shown. In some embodiments, connector 900 includes an insulated compliant rubber or plastic cover 70 having an opening for cable 80 to pass through, and sides and a top to cover the connector once installed. Cable 80 includes conductor 82 (such as stranded copper wire) covered by a compliant insulator such as rubber or plastic. Band clamp 94 is fit around cylindrical end 910 to compress it onto wire end 82, forming a mechanical and electrical connection to cable 80. In some embodiments, insulator cover 70 is shaped to substantially cover band clamp 94 and 95 once assembled, and to be removable for service, if needed. Inner surface 913 of conductor 902 conforms to battery post 99, and is urged against post 99 by band clamp 95 (which can be a conventional band clamp 70 as shown, or can be a top-drive band clamp 700 as shown in FIG. 7A.

FIG. 9E is a perspective exploded view of a replaceable-clamp battery connector 904. Connector 904 is identical to connector 900 described above, but is left in a vertical configuration for applications that would benefit from that configuration.

Figure 10A:
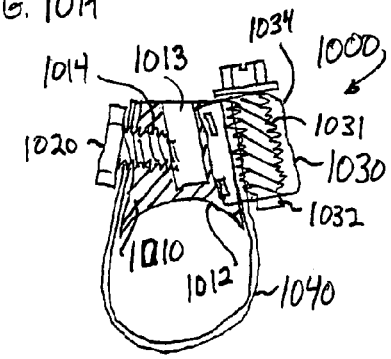
FIG. 10A is a top cut-away view of a battery connector 1000.
Figure 10B:
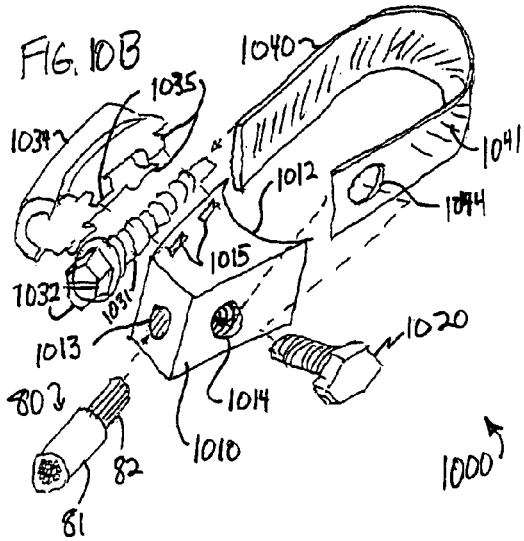
FIG. 10B is a perspective exploded view of a battery connector 1000.

FIG. 10A is a top cut-away view of a battery connector 1000, according to some embodiments of the invention. FIG. 10B is a perspective exploded view of battery connector 1000. In some embodiments, connector 1000 includes a machined or cast shaped solid block 1010 of copper, that, in some embodiments, is coated with tin, at least on inner radius surface 1012. Bolt 1020 passes through hole 1044 of slotted strap 1040, and threads into threaded hole 1014, such that its tip also presses against and holds wire end 82 of cable 80 into hole 1013. In some embodiments, screw housing 1034 has tabs 1035 that are stapled into tab slots 1015 in block 1010 to hold it in place. Worm screw 1032 has threads 1031 that interface with slots 1041 in band 1040, and when rotated, tighten or loosen the band clamp. As can be seen in FIG. 10A, in some embodiments, inner radius surface 1012 is concave to conform to the battery-terminal post and is adanted to cover at least one-fourth of the circumference of the battery cost.

Figure 11A:
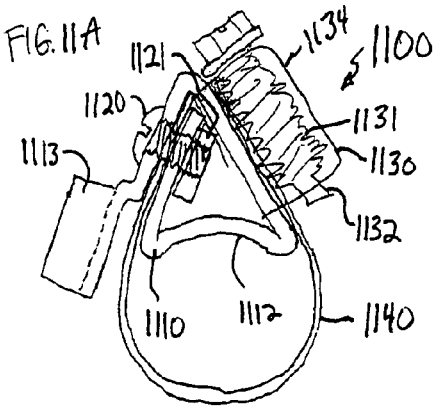
FIG. 11A is a top cut-away view of a battery connector 1100.
Figure 11B:
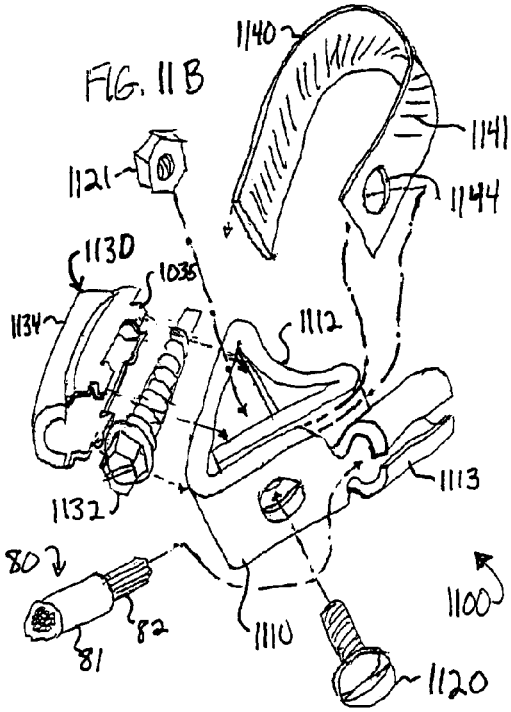
FIG. 11B is a perspective exploded view of a battery connector 1100.

FIG. 11A is a top cut-away view of a battery connector 1100. FIG. 11B is a perspective exploded view of battery connector 1100. In some embodiments, connector 1100 includes a stamped and folded bar 1110 of copper, that, in some embodiments, is coated with tin, at least on inner radius surface 1112. Bolt 1120 passes through hole 1144 of slotted strap 1140, and threads into nut 1121 (or, in other embodiments, into a tapped threaded hole 1117 of bar 1110. Cylindrical bent end 1113 of bar 1110 holds wire end 82 of cable 80 (in some embodiments, this connection is crimped, soldered, spot welded, or compressed by a band clamp 94 as shown in FIG. 9D. In some embodiments, screw housing 1134 has tabs 1035 that are stapled around conductor 1110 to hold it in place. Worm screw 1132 has threads 1131 that interface with slots 1141 in band 1140, and when rotated, tighten or loosen the band clamp. As shown in FIG. 11A. bar 1110 of this embodiment forms an electrical conductor having a concave surface 1112 configured to conform to the battery-terminal post, and adapted to cover at least one-fourth of a circumference of the battery post.

Figure 11C:
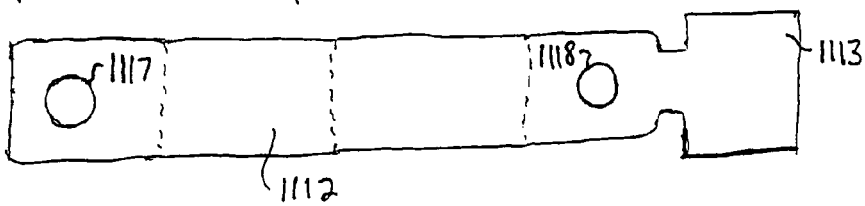
FIG. 11C is a plan view, before folding, of a stamped-metal radius conductor 1110.

FIG. 11C is a plan view, before folding, of stamped-metal radius conductor 1110. Once folded into the shape shown in FIG. 11B, holes 1117 and 1118 align with each other on either side of hole 1144 of strap 1140.

Figure 12:
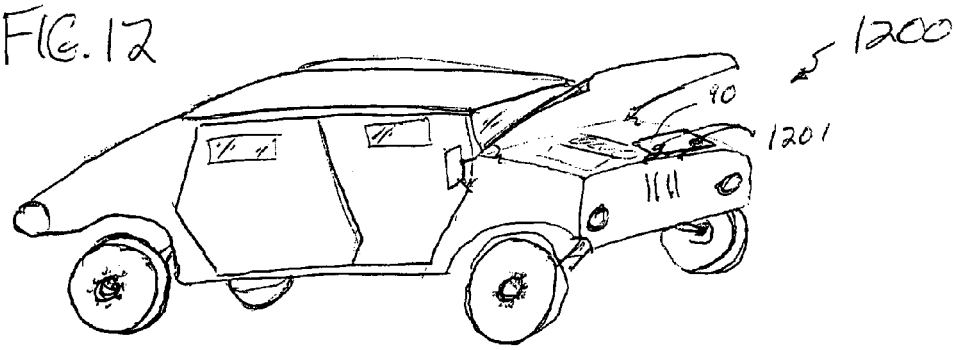
FIG. 12 is a perspective view of a vehicle 1200 that includes one or more battery connectors of the present invention.

FIG. 12 is a perspective view of a vehicle 1200 that includes one or more battery connectors 1201 of the present invention, connecting electrical power from battery 90 to vehicle 1200. In vehicle embodiments, vehicle 1200 can be a military vehicle as shown (either a land vehicle, or a boat, ship, aircraft, etc.) or a civilian automobile, truck, boat, or airplane. Other applications include connection to the power posts of solar installations, battery-powered backup energy sources such as for computer uninterruptible power supplies.

Figure 13A:
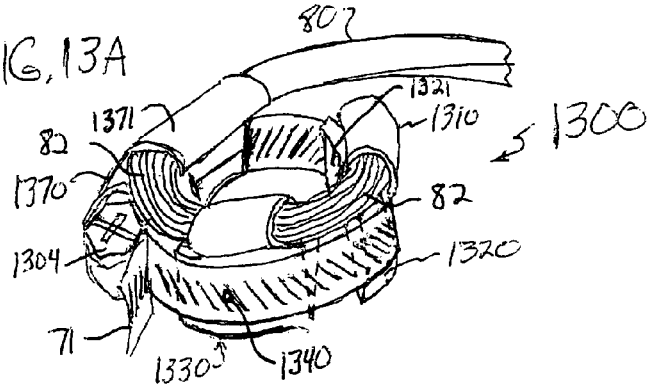
FIG. 13A is a perspective view of a connector assembly 1300 of some embodiments of the invention.
Figure 13B:
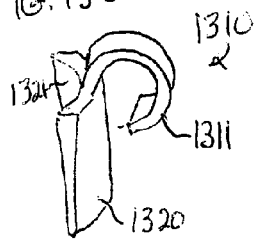
FIG. 13B is a perspective view of electrical contact 1310 of connector assembly 1300.
Figure 14A:
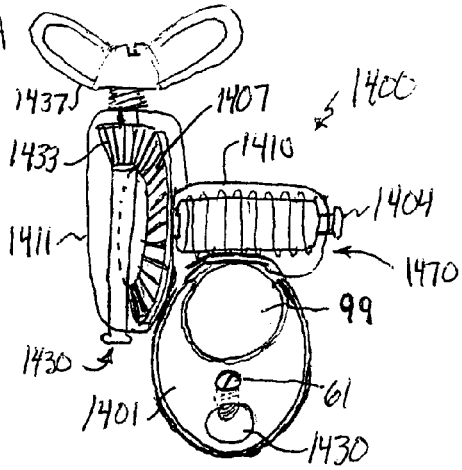
FIG. 14A is a top perspective view of top-driven clamp connector assembly 1400 that allows actuating beveled-gear worm-drive screw 1404 with a mechanically advantaged gear ratio, vertically or side oriented, beveled-gear head 1430.

FIG. 13A is a perspective view of a connector assembly 1300 of some embodiments of the invention. In some embodiments, connector assembly 1300 includes a plurality of conductor elements 1310, 1330, and/or a direct (e.g., stainless-steel) connection 1371 to wire 80. FIG. 13B is a perspective view of electrical contact 1310 of connector assembly 1300. In some embodiments, each one of the plurality of conductor elements 1310 (and 1330) is a copper (or other suitable conductive material) having an inner concave surface 1321 that conforms to a portion of the outer surface on battery post 80, and an outer surface 1320 that conforms to the band clamp (e.g., 1370) when that is tightened, and a formed wire receptacle 1311 (e.g., of stamped copper bent to form a cylindrical opening though which wire end 82 is passed) that can be attached to the wire, such as by crimping, welding, soldering, or band clamping. In some embodiments, the housing of band clamp 1370 includes a cylindrical opening 1371 though which the wire end 82 is passed and attached. In some embodiments, a horizontally oriented worm-drive screw 1304 is provided, while in other embodiments, a top-drive band clamp (such as shown in FIG. 3A) or a mechanically advantaged top or side drive band clamp (such as shown in FIG. 14A) is used. In some embodiments, one or more of the plurality of conductors 1310, 1330 are riveted or welded 1340 to band 71. Improved reliability is achieved by having a plurality of wire connection points (1311 and/or 1371) to the wire end 82, such that redundant conduction paths and connections are provided.

Figure 14B:
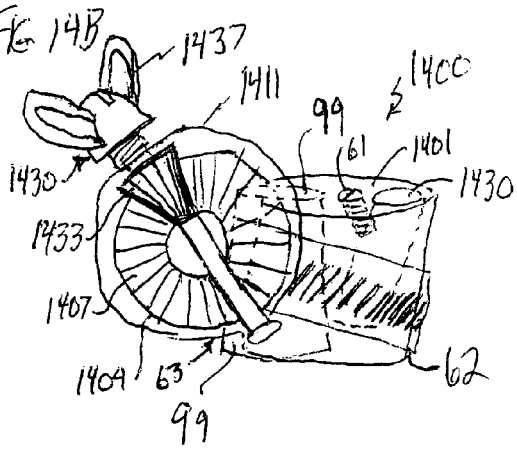
FIG. 14B is a side perspective view of clamp 1400 showing the gear end of beveled-gear worm-drive screw 1404.

FIG. 14A is a top perspective view of mechanically advantaged top-driven clamp connector assembly 1400 that allows hand actuating beveled-gear worm-drive screw 1404 with a mechanically advantaged gear ratio, vertically or side oriented, beveled-gear head 1430. FIG. 14B is a side perspective view of connector assembly 1400 showing the gear end of beveled-gear worm-drive screw 1404. The gear configuration of bevel gear 1433 and larger bevel gear 1407 provides a mechanical advantage that allows band clamp 1470 to be hand-tightened without tools. In some embodiments, band clamp 1470 includes a first housing 1410 that holds grooves near both ends of worm-drive screw 1404, and a second housing 1411 that holds grooves near both ends of hand-actuated drive head 1430, and hold bevel gear 1433 against larger bevel gear 1407. Head 1437 can be any suitable form, such as a wing nut or a knurled knob, and in some embodiments, includes a feature such as a slot for use with a screwdriver if extra leverage is needed. In some embodiments, band clamp 1470 contacts directly against battery post 99 to provide a redundant current path. In some embodiments, a hole 1430 is provided in conductor 1401 for inserting wire end 82, and a set screw 61 or other suitable clamp is provided to hold wire end 82 in place. In some embodiments, the outer cylindrical (or oval prism) shape of conductor 1401 is tilted to provide clamping pressure 62 at the lower portion of post 99 (on the lower right side of the FIG. 14B), while having the worm-screw end 63 raised relative to the battery surface and post 99, in order to provide more vertical clearance for bevel gear 1407.

One further consideration of material usage is that of its environmental impact. The materials used here have far less negative environmental impacts in comparison to the traditional lead-containing connectors.

In some embodiments, the invention provides a connector apparatus for use in connecting a battery-power cable to a battery-terminal post. This connector includes a tightenable adjustment band that provides for connector installation, removal and tension adjustment, a band-tightness-adjustment assembly operatively coupled to the band and a radius electrical conductor that provides a primary electrical current path and includes a cable-wire-attachment feature to enable power distribution through a cable, wherein the band-tightness-adjustment assembly, the band, and the radius electrical conductor form a tightenable inner opening that can surround and tighten on the battery-terminal post.

In some embodiments, the adjustment band includes a plurality of slots, and the band-tightness-adjustment assembly includes a worm-drive screw that interfaces with the slots to tighten the banc, the screw having a drive head that includes a slot configured for use with a conventional slot-drive screwdriver, a cross slot configured for use with a conventional Philips screwdriver and a hexagonal head configured for use with a conventional hexagonal wrench.

In some embodiments, the slotted adjustment strap includes slots restricted to about one centimeter or less to maximize mechanical strength and electrical contact.

In some embodiments, the band-tightness-adjustment assembly includes a stainless steel slotted adjustment strap, providing a relatively corrosion resistant secondary electrical current path.

In some embodiments, the radius electrical conductor includes a copper radius contact at least partially coated with tin to make the contact galvanically compatible with the battery-terminal post and copper-wire cable.

In some embodiments, the worm-drive adjustment assembly includes a radius contact bonded in electrical communication with the slotted adjustment strap.

In some embodiments, the band-tightness-adjustment assembly includes a worm-drive screw having a beveled gear head, and a tool-interface head that mates with and provides screw actuation to the screw through a perpendicularly oriented beveled gear drive head.

Some embodiments further include the battery-power cable attached to the connector.

Some embodiments further include a motor vehicle having a battery, the battery having a battery-terminal post, and a battery-power cable connected to the connector to electrically connects the battery to the vehicle.

Another aspect of the invention, in some embodiments, is a connector kit for use in the connection of a power cable to a power terminal post. The kit includes a band clamp and an electrical-contact conductor that provides a primary electrical current path and having a concave surface configured to conform to an outer surface of the post, a convex outer surface that is configured to conform to an inner surface of the band clamp when tightened, and a cable attachment to enable power distribution through the cable.

In some embodiments, the band clamp includes a worm-drive screw with a head providing a slot for use with a conventional slotted screwdriver, a cross slot for use with a conventional Philips screwdriver and a hexagonal head for use with a conventional hexagonal wrench.

In some embodiments, the band clamp includes slots in a slotted adjustment strap that are restricted to about 1.25 cm or less for adjustment to increase mechanical and electrical contact.

In some embodiments, the band clamp includes a stainless-steel slotted adjustment strap, providing a relatively corrosion proof secondary electrical current path.

In some embodiments, the electrical-contact conductor is bonded in electrical communication with the band clamp.

In some embodiments, the electrical-contact conductor includes a tin-coated copper concave electrical contact bonded in electrical communication with the slotted adjustment strap.

In some embodiments, the band clamp includes a worm-drive screw having a beveled gear head that mates with and provides screw actuation through a perpendicularly oriented beveled gear drive head.

Yet another aspect of the invention, in some embodiments, is method of connecting a battery cable to a battery post. The method includes providing an electrical-contact conductor having a concave surface configured to conform to an outer surface of the post, and a convex outer surface that is configured to conform to an inner surface of a band clamp when tightened, attaching a cable to the electrical-contact conductor, and band-clamping the electrical-contact conductor to the battery post to enable power distribution through the cable.

In some embodiments, the band clamping includes providing a mechanically advantaged rotation to a worm screw to tighten the conductor-to-post contact.

In some embodiments, the attaching of the cable further comprises band clamping the electrical-contact conductor to the cable.

Also described, in some embodiments, is a apparatus for use in the connection of a power cable to a power-terminal post, the apparatus including an electrical-contact conductor that provides a primary electrical current path and having a concave surface configured to conform to an outer surface of the post, a convex outer surface that is configured to conform to an inner surface of the band clamp when tightened, and a cable attachment to enable power distribution through the cable; and clamping means to exert force to connect the electrical-contact conductor to the power-terminal post.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A connector apparatus for use in connecting a battery-power cable to a battery-terminal post, the battery post having a circumference and a convex outer surface, the connector comprising:

a tightenable adjustment band that provides for connector installation, removal and tension adjustment;

a band-tightness-adjustment assembly operatively coupled to the band to form a first band clamp; and a radius electrical conductor that provides a primary electrical current path and includes a cable-wire-attachment feature to enable power distribution from the battery-terminal post through the cable, wherein the band-tightness-adjustment assembly, the band, and the radius electrical conductor form a tightenable inner opening configured to surround and tighten on the battery-terminal post, wherein the radius electrical conductor has a concave surface configured to conform to at least a portion of the convex outer surface of the battery-terminal post, and adapted to cover and contact at least one-fourth of the conformed-to convex portion of the circumference of the battery-terminal post.

2. The apparatus of claim 1, wherein the adjustment band includes a plurality of slots, and the band-tightness-adjustment assembly includes a worm-drive screw that interfaces with the slots to tighten the band, the screw having a drive head that includes a slot configured for use with a conventional slot-drive screwdriver, a cross slot configured for use with a conventional Philips screwdriver and a hexagonal head configured for use with a conventional hexagonal wrench.

3. The apparatus of claim 1, wherein the tightenable adjustment band includes a slotted adjustment strap having slots restricted to about one centimeter or less to maximize mechanical strength and electrical contact.

4. The apparatus of claim 1, wherein the adjustment band comprises a stainless steel slotted adjustment strap, providing a relatively corrosion resistant secondary electrical current path.

5. The apparatus of claim 1, wherein the radius electrical conductor includes a copper radius contact at least partially coated with tin to make the contact galvanically compatible with a non-copper battery-terminal post and with a copper-wire cable.

6. The apparatus of claim 1, wherein the band-tightness-adjustment assembly includes a radius contact bonded in electrical communication with a slotted adjustment strap.

7. The apparatus of claim 1 further comprising the battery-power cable attached to the connector.

8. The apparatus of claim 1, further comprising:

a motor vehicle having a battery, the battery having the battery-terminal post; and the battery-power cable that electrically connects the connector to the vehicle.

9. The apparatus of claim 1, further comprising a second band clamp, wherein the cable-wire-attachment feature is configured to attach to the cable using compressive force from the second band clamp.

10. The apparatus of claim 1, wherein the radius electrical conductor comprises:

a metal piece having a plurality of external segments including a first, second and third segment;

wherein the first segment is affixed to a first end of the slotted adjustment strap;

wherein the second segment has a concave, rounded surface shaped to conform to an outer surface of a rounded battery terminal;

wherein the band-tightening-adjustment assembly is affixed to the third segment; and the metal piece further having a cable-attachment segment formed to attach to a cable conductor.

11. The apparatus of claim 1, wherein:

the tightenable adjustment band includes a first opening through a surface of the band, and a plurality of slots;

the band-tightness-adjustment assembly includes a worm-drive screw that interfaces with the slots to tighten the band; and the radius electrical conductor includes a metal cable-connection post that fits through the first opening in the band, and wherein the cable-connection post is configured to connect to a battery cable.

12. The apparatus of claim 11, wherein:

the band-tightness-adjustment assembly is attached to the tightenable adjustment band at a position opposite from the radius electrical conductor.

13. The apparatus of claim 11, wherein the apparatus is configured such that at least a portion of the concave surface of the radius electrical conductor and at least a portion of the band are simultaneously in electrical contact with the battery-terminal post when the band is tightened.

14. The apparatus of claim 1, wherein:

the concave surface of the radius electrical conductor conforms to a tapered cylindrical surface.

15. The apparatus of claim 1, wherein the radius electrical conductor is adapted to cover at least one-fourth of the circumference of the battery-terminal post.

16. A connector kit for use in the connection of a power cable to a power-terminal post, the power-terminal post having a circumference and a convex outer surface, the kit comprising:

a first band clamp; and an electrical-contact conductor that provides a primary electrical current path contact and having a concave surface configured to conform to and contact the convex outer surface of the post, an outer surface that is configured to conform to an inner surface of the band clamp when tightened, and a cable attachment to enable power distribution through the cable, wherein the electrical-contact conductor is configured to cover at least one-fourth of a circumference of the power-terminal post, and wherein the electrical-contact conductor is configured such that the first band clamp, when tightened, contacts the power terminal post to form a secondary electrical current path.

17. The connector kit of claim 16, wherein the band clamp includes a worm-drive screw with a head providing a slot for use with a conventional slotted screwdriver, a cross slot for use with a conventional Philips screwdriver and a hexagonal head for use with a conventional hexagonal wrench.

18. The connector kit of claim 16, wherein the band clamp includes slots in a slotted adjustment strap that are restricted to about 1.25 cm or less for adjustment to increase mechanical and electrical contact.

19. The connector kit of claim 16, wherein the band clamp includes a stainless-steel slotted adjustment strap, providing a relatively corrosion proof secondary electrical current path.

20. The connector kit of claim 16, wherein the electrical-contact conductor is bonded in electrical communication with the band clamp.

21. The connector kit of claim 16, wherein the electrical-contact conductor includes a tin-coated copper concave electrical contact bonded in electrical communication with the band clamp.

22. The connector kit of claim 16, wherein the kit further comprises a second band clamp, wherein the electrical-contact conductor is configured to attach to the cable using compressive force from the second band clamp.

23. The kit of claim 16, wherein the first band clamp includes a tightenable band that includes a plurality of slots and a band-tightness-adjustment assembly that includes a worm-drive screw that interfaces with the slots to tighten the band; and the electrical-contact conductor includes a metal cable-connection portion configured to pass over the band and electrically connect to a battery cable outside the tightenable band.

24. The kit of claim 16, wherein the first band clamp includes a tightenable band that includes a plurality of slots and a band-tightness-adjustment assembly that includes a worm-drive screw that interfaces with the slots to tighten the band;

the power terminal post, to which the electrical-contact conductor is configured to conform, has a longitudinal axis that extends substantially perpendicular from a surface, and the electrical-contact conductor has an outer surface configured at an angle so as to tilt the first band clamp at an angle relative to the longitudinal axis of the post.

25. A method of connecting a battery cable to a battery post, the battery post having a circumference and a convex outer surface, the method comprising:

providing an electrical-contact conductor having a concave surface configured to conform to at least a portion of the convex outer surface of the post, and to cover and contact at least one-fourth of the circumference of the battery post, and an outer surface that is configured to conform to an inner surface of a band clamp when tightened;

attaching a cable to the electrical-contact conductor; and band-clamping the electrical-contact conductor to the battery post to enable power distribution through the cable.

26. The method of claim 25, wherein the band clamping includes providing a mechanically advantaged rotation to a worm screw to tighten a conductor-to-post contact.

27. The method of claim 25, wherein the attaching of the cable further comprises band clamping the electrical-contact conductor to the cable.

28. The method of claim 25, wherein the providing of the electrical contact conductor further includes:

providing an adjustment strap and band-tightening adjustment assembly;

forming a metal strap into a plurality of segments including a first, second and third segment wherein the second segment is formed to a shape that conforms to the battery post; and affixing a first end of the adjustment strap to the first segment, and the band-tightening adjustment assembly to the third segment.

29. The method of claim 25, wherein the radius electrical-contact conductor that is provided is configured to cover at least one-fourth of the circumference of the battery-terminal post.

30. An apparatus for use in the connection of a power cable to a power-terminal post, the power-terminal post having a circumference and a convex outer surface, the apparatus comprising:

an electrical-contact conductor that provides a primary electrical current path and having a concave surface configured to conform to an outer surface of the power-terminal post and cover and contact at least one-fourth of the circumference of the power-terminal post, when tightened, and a cable attachment to enable power distribution through the cable; and band-clamping means for exerting force to connect the electrical-contact conductor to the power-terminal post, wherein the band-clamping means provide a secondary electrical path and the electrical-contact conductor includes an outer surface that is configured to conform to an inner surface of the band-clamping means when the band-clamping means is tightened.

31. The apparatus of claim 30, wherein the clamping means further includes a slotted band and worm screw to tighten the conductor-to-post contact.

32. The apparatus of claim 30, further comprising means for band clamping the electrical-contact conductor to the cable.

33. The apparatus of claim 30, further comprising:

a motor vehicle having a battery, the battery having the battery-terminal post; and the battery-power cable that electrically connects the electrical-contact conductor to the vehicle.

34. A connector apparatus for use in connecting a battery-power cable to a battery-terminal post, the connector comprising:

a tightenable adjustment band that provides for connector installation, removal and tension adjustment;

a band-tightness-adjustment assembly operatively coupled to the band to form a first band clamp; and a radius electrical conductor that provides a primary electrical current path and includes a cable-wire-attachment feature to enable power distribution from the battery-terminal post through the cable, wherein the band-tightness-adjustment assembly, the band, and the radius electrical conductor form a tightenable inner opening configured to surround and tighten on the battery-terminal post, wherein the radius electrical conductor comprises:

a metal strap fanned into a plurality of segments including a first, second and third segment;

wherein the first segment is affixed to a first end of the slotted adjustment strap;

wherein the second segment has a concave, rounded surface shaped to conform to an outer surface of a rounded battery terminal;

wherein the band-tightening-adjustment assembly is affixed to the third segment; and the metal strap further having a cable-attachment segment formed to attach to a cable conductor.

* * * * *